US010065428B2

(12) United States Patent
Ohtsu et al.

(10) Patent No.: US 10,065,428 B2
(45) Date of Patent: Sep. 4, 2018

(54) LIQUID CIRCULATION MODULE AND LIQUID EJECTION APPARATUS

(71) Applicant: TOSHIBA TEC KABUSHIKI KAISHA, Shinagawa-ku, Tokyo (JP)

(72) Inventors: Kazuhiko Ohtsu, Mishima Shizuoka (JP); Kazuhiro Hara, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/427,257

(22) Filed: Feb. 8, 2017

(65) Prior Publication Data

US 2017/0297346 A1 Oct. 19, 2017

(30) Foreign Application Priority Data

Apr. 19, 2016 (JP) ..... 2016-083562

(51) Int. Cl.
*B41J 2/18* (2006.01)
*B41J 2/14* (2006.01)
(Continued)

(52) U.S. Cl.
CPC ..... *B41J 2/18* (2013.01); *B41J 2/14233* (2013.01); *B41J 2/175* (2013.01); *B41J 2/17509* (2013.01);
(Continued)

(58) Field of Classification Search
CPC .... B41J 2/175; B41J 2/17513; B41J 2/17523; B41J 2/17553; B41J 2/17556;
(Continued)

(56) References Cited

U.S. PATENT DOCUMENTS 5,757,573 A * 5/1998 Tokuyama ..... G11B 5/10 360/235.4
7,874,656 B2 * 1/2011 Ota ..... B41J 2/17556 347/85
(Continued)

FOREIGN PATENT DOCUMENTS

JP 2016-052767 4/2016
JP 2016-052768 4/2016

OTHER PUBLICATIONS

Extended European Search Report for European Patent Application No. 17160239.4 dated Sep. 22, 2017.

*Primary Examiner* — Anh T. N. Vo
(74) *Attorney, Agent, or Firm* — Amin, Turocy & Watson LLP

(57) ABSTRACT

In accordance with an embodiment, a liquid circulation module comprises a liquid ejection head for ejecting liquid, a storage section connected with the liquid ejection head to store the liquid, a circulation section configured to circulate the liquid in a predetermined circulation path passing through the liquid ejection head and the storage section, a pressure detection section configured to detect pressure in the storage section, a pressure adjusting section configured to adjust pressure in the storage section, and a module controller configured to control a circulation operation of the circulation section and a pressure adjusting operation of the pressure adjusting section independently from a host controller arranged separately from the liquid circulation module and when communicating with the host controller.

20 Claims, 10 Drawing Sheets

(51) Int. Cl.
*B41J 2/175* (2006.01)
*B41J 29/38* (2006.01)

(52) U.S. Cl.
CPC ..... *B41J 2/17556* (2013.01); *B41J 2/17566* (2013.01); *B41J 2/17596* (2013.01); *B41J 29/38* (2013.01); *B41J 2202/12* (2013.01)

(58) Field of Classification Search
CPC ..... B41J 2/17566; B41J 2/17596; B41J 2/18; B41J 2202/12
See application file for complete search history.

(56) References Cited

U.S. PATENT DOCUMENTS

| | | | | |
|---|---|---|---|---|
| 7,901,196 | B2 * | 3/2011 | Narasimalu | B29C 43/36 425/116 |
| 8,128,212 | B2 * | 3/2012 | Katada | B41J 2/175 347/89 |
| 8,231,211 | B2 | 7/2012 | Okawa | |
| 8,403,439 | B2 * | 3/2013 | Tanaka | B41J 2/175 347/17 |
| 9,421,784 | B2 * | 8/2016 | Kumagai | B41J 2/125 |
| 9,636,921 | B2 * | 5/2017 | Ishikawa | B41J 2/18 |
| 2010/0085396 | A1 | 4/2010 | Yokota et al. | |
| 2014/0292963 | A1 | 10/2014 | Hara et al. | |
| 2015/0070415 | A1 * | 3/2015 | Ishikawa | B41J 2/175 347/6 |
| 2016/0067982 | A1 | 3/2016 | Kuribayashi | |

* cited by examiner

LIQUID CIRCULATION MODULE AND LIQUID EJECTION APPARATUS

CROSS-REFERENCE TO RELATED APPLICATION

This application is based upon and claims the benefit of priority from Japanese Patent Application No. P2016-083562, filed Apr. 19, 2016, the entire contents of which are incorporated herein by reference.

FIELD

Embodiments described herein relate generally to a liquid circulation module and a liquid ejection apparatus and methods associated therewith.

BACKGROUND

A liquid circulation module connected with a liquid ejection head and a circulation device is developed. The liquid circulation module is used in, for example, a liquid ejection apparatus, in other words, an inkjet recording apparatus for ejecting ink onto an image receiving medium to record an image. A host control device for carrying out an operation control of a circulation operation of the circulation device is necessary in the liquid circulation module. The host control device which is constituted separately from the liquid circulation module is arranged at the outside of the liquid circulation module. Thus, since the liquid circulation module is usually connected with the host control device via a communication cable for mutual communication, the usability of the liquid circulation module is poor. In view of such a problem, a liquid circulation module that is easy to use is desired.

DETAILED DESCRIPTION

In accordance with an embodiment, a liquid circulation module comprises a liquid ejection head for ejecting liquid, a storage section connected with the liquid ejection head to store the liquid, a circulation section configured to circulate the liquid in a predetermined circulation path through the liquid ejection head and the storage section, a pressure detection section configured to detect pressure in the storage section, a pressure adjusting section configured to adjust pressure in the storage section, and a module controller configured to control a circulation operation of the circulation section and a pressure adjusting operation of the pressure adjusting section independently from a host controller arranged separately from the liquid circulation module and when communicating with the host controller.

In accordance with another embodiment, a liquid circulation method for an inkjet recording apparatus involves circulating inkjet liquid in a predetermined circulation path through a liquid ejection head and a storage section; detecting pressure in the storage section; adjusting pressure in the storage section; and controlling circulating inkjet liquid and adjusting pressure in the storage section without using a host device.

Hereinafter, an inkjet recording apparatus 10 according to an embodiment is described with reference to FIG. 1 to FIG. 8. For the sake of explanation in each diagram, the configuration is appropriately enlarged, reduced or omitted.

Figure 1:
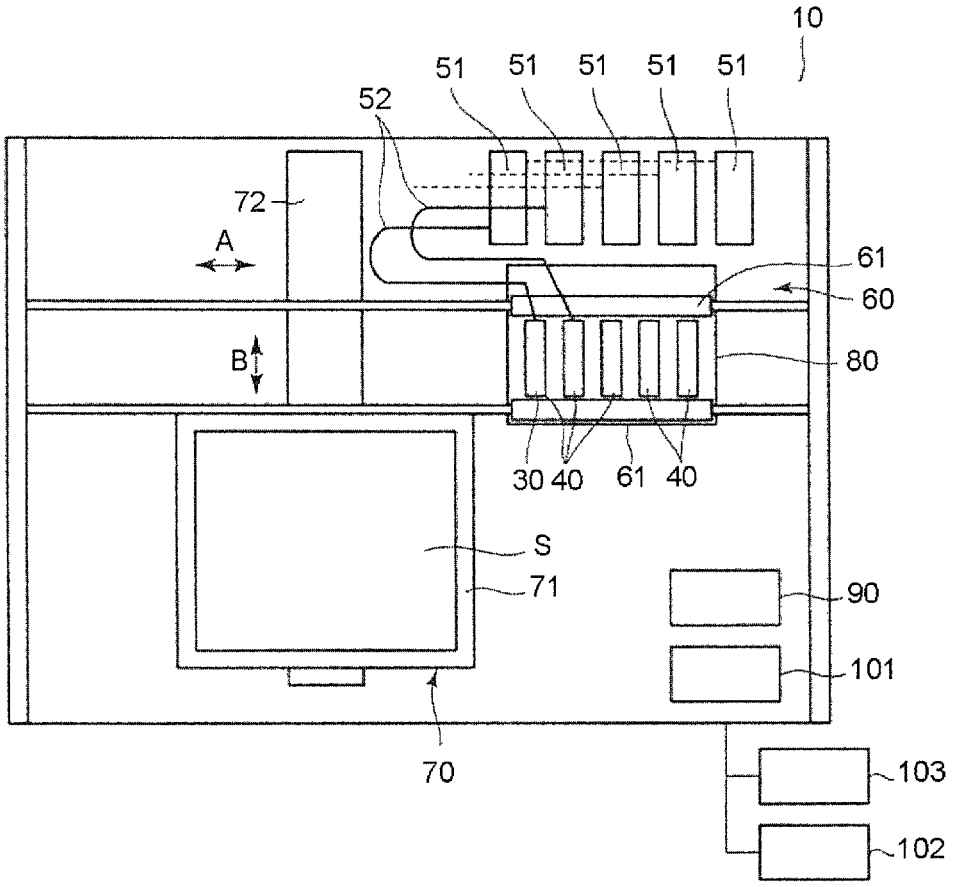
FIG. 1 is a front view of an inkjet recording apparatus according to an embodiment.
Figure 2:
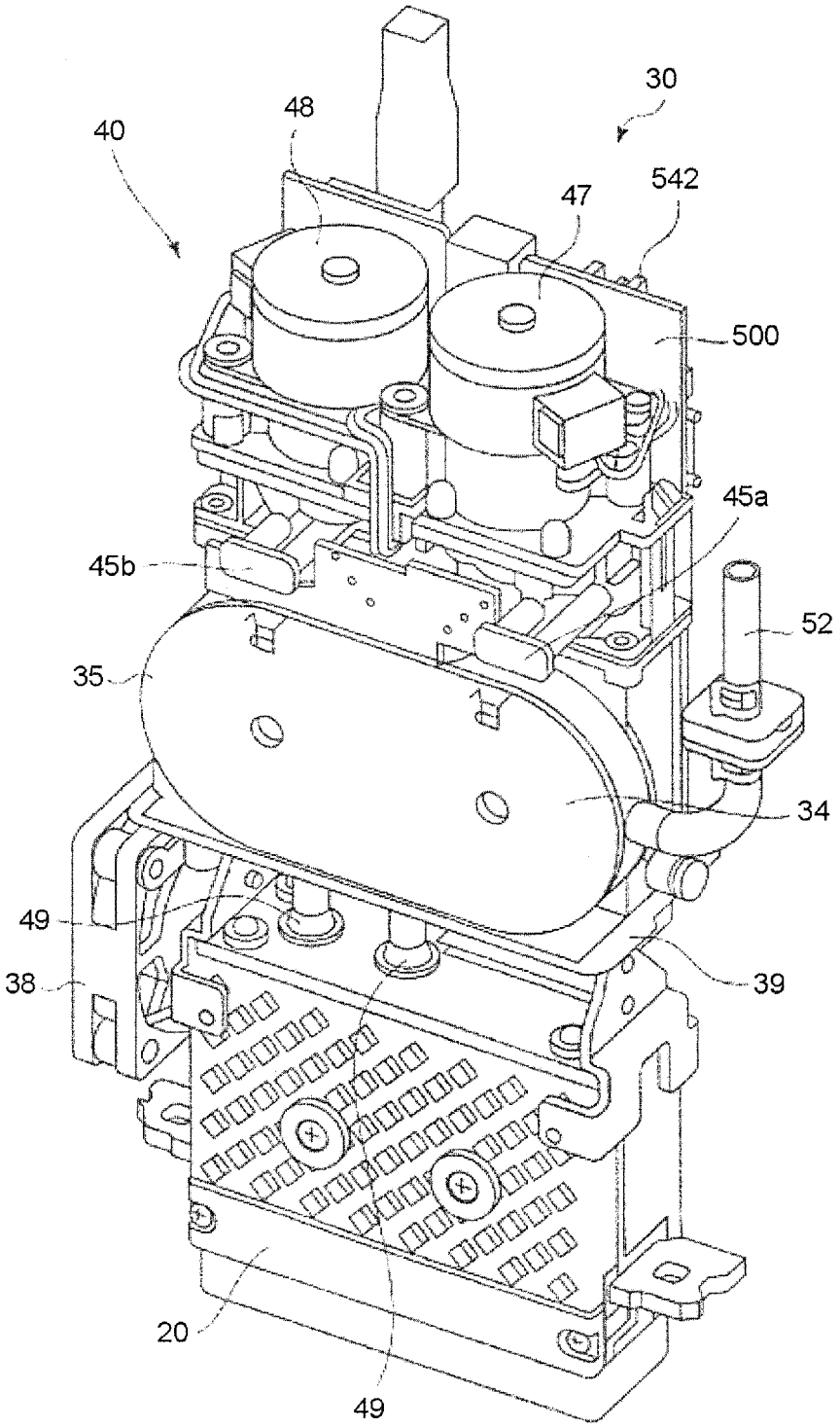
FIG. 2 is a perspective view of an ink supply circulation module of the inkjet recording apparatus.
Figure 3:
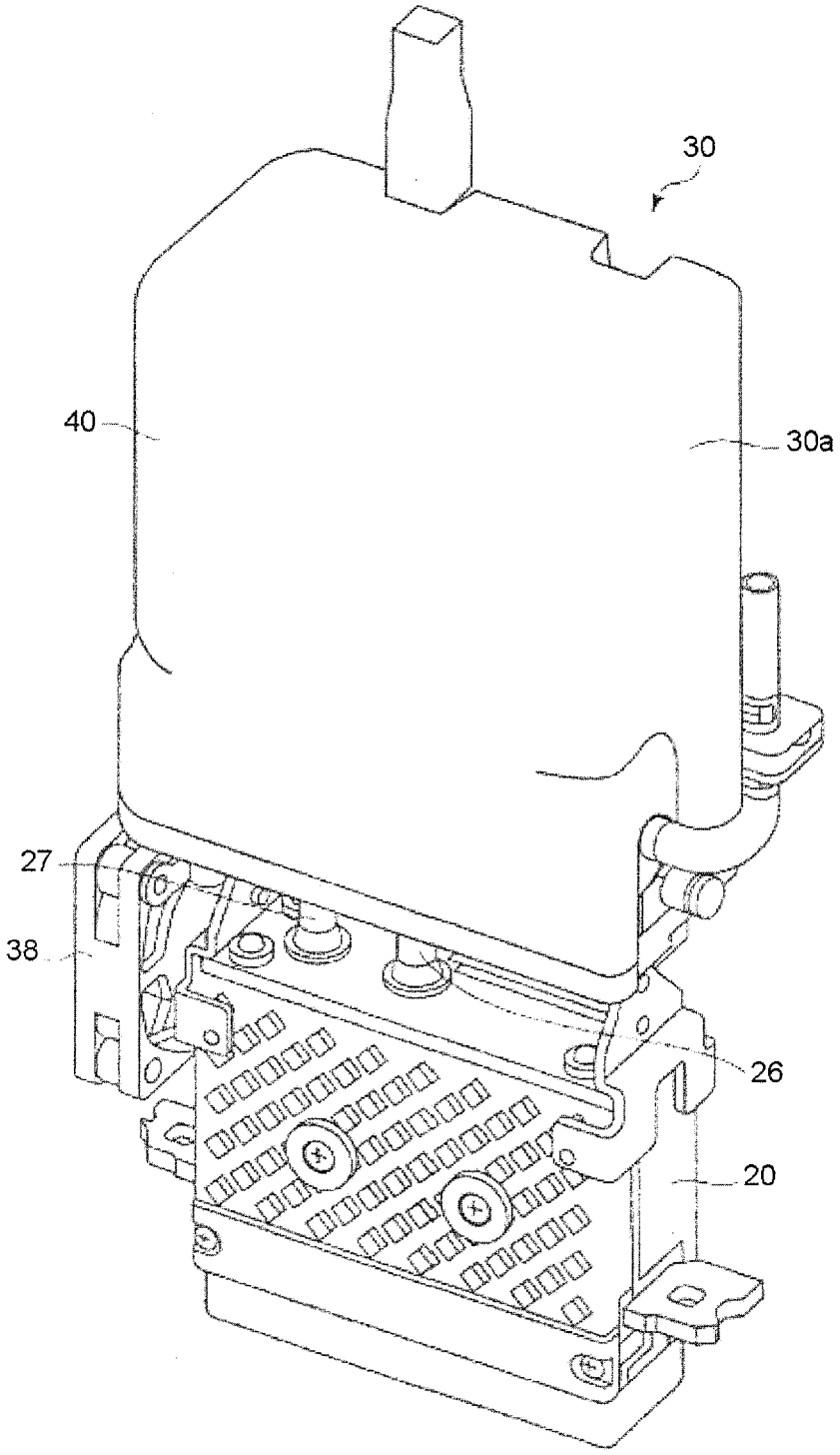
FIG. 3 is a perspective view of the ink supply circulation module of the inkjet recording apparatus.

As shown in FIG. 1 and FIG. 2, the inkjet recording apparatus 10, which is an example of a liquid ejection apparatus, comprises a plurality of ink supply circulation modules 40, an ink cartridge 51, a head support section 60, an image receiving medium moving section 70, a maintenance unit 80, a host control device 90 (host controller), a power source 101, an input device 102 and a display device 103.

The ink supply circulation module 40 shown in FIG. 1 to FIG. 4 which is a liquid circulation module integrally includes an inkjet head 20 which is a liquid ejection head and an ink circulation device 30 which is a liquid circulation device. The plurality of the ink supply circulation modules 40 respectively ejects, for example, cyan ink, magenta ink, yellow ink, black ink and white ink to a medium to forma desired image; however, colors or characteristics of the ink that is respectively used are not limited. For example, instead of the white ink, transparent glossy ink, special ink which develops color when irradiated with infrared rays or ultraviolet rays can be discharged. The plurality of the inkjet heads 20 has the same constitution although the used ink is different. Therefore, description thereof is made by designating the same numerals.

Figure 5:
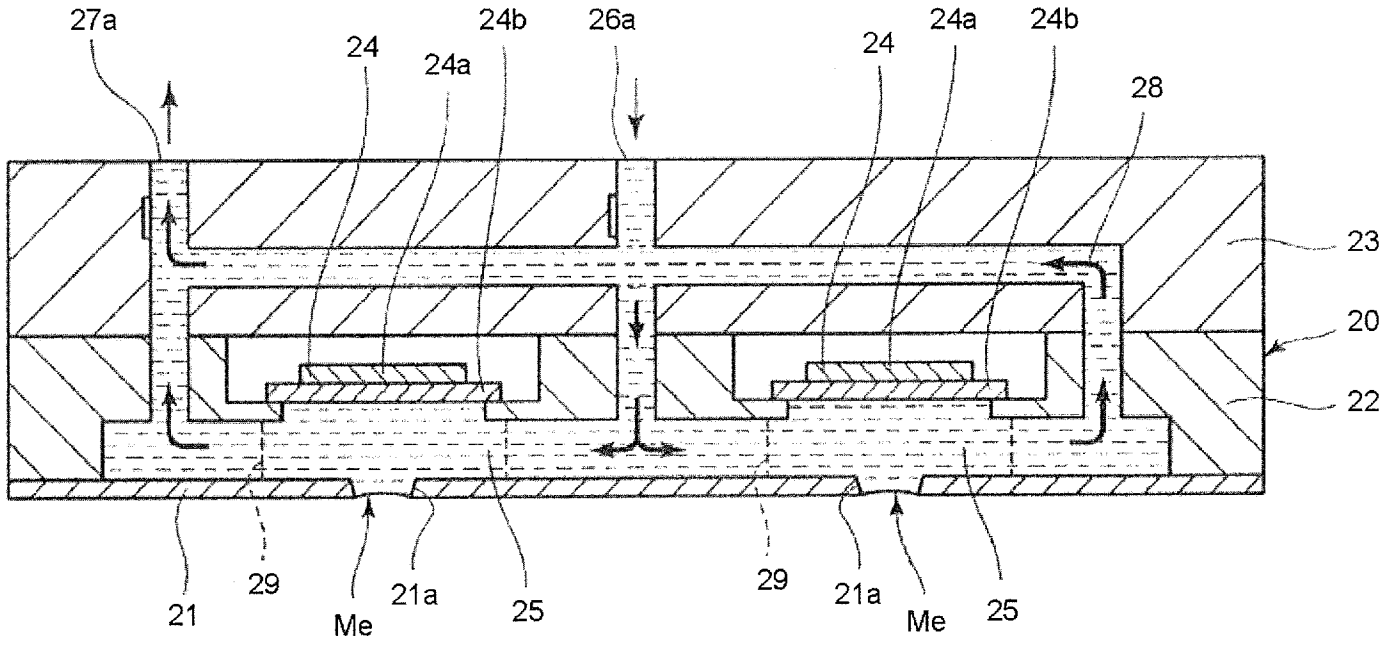
FIG. 5 is a view illustrating the structure of an inkjet head of the inkjet recording apparatus.

As shown in FIG. 5, the inkjet head 20 includes a nozzle plate 21 having a plurality of nozzles, a substrate 22, a manifold 23 jointed with the substrate 22, and a head drive circuit 543. The head drive circuit 543 is connected with the host control device 90 of the inkjet recording apparatus.

The nozzle plate 21 is provided with a first nozzle row and a second nozzle row respectively having about 150 nozzles per inch. The nozzle plate 21, the substrate 22 and the manifold 23 constitute a predetermined ink flow path 28 at the inner side of the inkjet head 20. The ink droplet quantity in each nozzle of the inkjet head 20, for example, is about 100 pl or less.

The substrate 22 is jointed with the nozzle plate 21 and opposite to the nozzle plate 21, and is formed into a predetermined shape for forming the predetermined ink flow path 28 containing a plurality of ink pressure chambers 25 between the nozzle plate 21 and the substrate 22. An actuator 24 is arranged at a portion facing each ink pressure chamber 25 of the substrate 22. The substrate 22 is provided with partition walls 29 arranged between the plurality of the ink pressure chambers 25 in the same row. The actuator 24 is arranged opposite a nozzle hole 21*a*, and the ink pressure chamber 25 is formed between the actuator 24 and the nozzle hole 21*a*.

The manifold 23 is jointed with the upper part of the substrate 22. The manifold 23 includes a supply port and a discharging port communicating with the ink circulation device 30, and is formed into a predetermined shape for forming the predetermined ink flow path 28 in a state of being incorporated into the substrate 22 and the nozzle plate 21.

The actuator 24 is composed of a unimorph type piezoelectric vibration plate in which a piezoelectric element 24*a* and a vibration plate 24*b* are laminated. For example, the piezoelectric element is made of a piezoelectric ceramic material such as PZT (lead zirconate titanate), etc. For example, the vibration plate is formed of SiN (silicon nitride) or the like.

The piezoelectric element 24*a* includes electrodes 24*c* and 24*d* vertically. In a case in which the voltage is not applied to the electrodes 24*c* and 24*d*, the piezoelectric element 24*a* is not deformed, and thus, the actuator 24 is not deformed. If the actuator 24 is not deformed, through surface tension of the ink, a meniscus Me which is an interface between an ink I and the air is formed in the nozzle hole 21*a*, and the ink I in the ink pressure chamber 25 remains in the nozzle hole 21*a*.

If a voltage (V) is applied to the electrodes 24*c* and 24*d*, the piezoelectric element 24*a* is deformed and the actuator 24 is also deformed. Through the deformation of the actuator 24, the pressure (positive pressure) applied to the meniscus Me is higher than air pressure, and the ink I breaks the meniscus Me and becomes an ink droplet ID to be ejected from the nozzle hole 21*a*.

As shown in FIG. 2, FIG. 3, FIG. 4 and FIG. 6, the ink circulation device 30 includes an ink casing 33 which is a storage section, a supply pump 34 which is a supply section, a circulation pump 35 which is a circulation section, a pressure adjusting section 36, and a module control device 500 which is a module controller. These components are covered by a cover 30*a*. The cover 30*a* constitutes an outer wall of the ink circulation device 30. Further, the cover 30*a* is omitted so as to show the internal constitution in FIG. 2.

The ink circulation device 30 is integrally arranged at the upper part of the inkjet head 20. In particular, the ink casing 33 is loaded on the inkjet head 20, and the pressure adjusting section 36 is loaded on the ink casing 33. The circulation pump 35 and the supply pump 34 are loaded at one side of an assembled component composed of the ink casing 33 and the pressure adjusting section 36, and a control substrate is arranged at the other side thereof. In a plain view, the appearance of the cover 30*a* constituting the outer wall of the ink circulation device 30 and the appearance of the inkjet head 20 are formed into the same size and shape.

The ink casing 33 includes a supply chamber 31 communicating with a supply port 26*a* of the inkjet head 20 and a collection chamber 32 communicating with an ink discharging port 27*a*. The ink casing 33 is provided with a common wall 37 intervening between the collection chamber 32 and the supply chamber 31. The supply chamber 31 is capable of storing the ink I to be supplied to the inkjet head 20. The collection chamber 32 which can retain the ink I is capable of storing the ink I collected from the inkjet head 20. The ink casing 33 is sealed with respect to outside air.

The collection chamber 32 communicates with the ink discharging port 27*a* of the inkjet head 20 via an ink returning pipe 27. A liquid hole 32*c* is formed in the collection chamber 32. The supply chamber 31 includes a first communicating hole 31*d* communicating with a first pressure adjusting mechanism 47 of the pressure adjusting section 36. The collection chamber 32 includes a second communicating hole 32*d* communicating with a second pressure adjusting mechanism 48 of the pressure adjusting section 36.

The supply chamber 31 communicates with the supply port 26*a* of the inkjet head 20 via the ink supply pipe 26. The supply chamber 31 is connected with the ink cartridge 51 via a tube 52. A liquid hole 31*b* which is a route of the supplied ink is formed in the supply chamber 31.

The supply pump 34 supplies the ink retained in the ink cartridge 51 to the supply chamber 31. The supply pump 34 is, for example, a piezoelectric pump, and is connected with a drive circuit 540 via a wiring. The supply pump 34 feeds the ink to the supply chamber 31 from the ink cartridge 51 through repeating expansion and contraction of the pump chamber via the drive circuit 540 if the piezoelectric actuator is operated with an alternating current voltage.

In the ink circulation device 30, a circulation path 41*a* reaching the liquid hole 31*b* of the supply chamber 31 from the liquid hole 32*c* of the collection chamber 32 is formed, and the circulation pump 35 and the filter 43 are arranged in the circulation path 41*a*. The circulation pump 35 circulates the ink I through a flow path from the collection chamber 32 to the collection chamber 32 again via the supply chamber 31 and the inkjet head 20.

The circulation pump 35 is a piezoelectric pump and is connected to the drive circuit 540 through the wiring. If the piezoelectric actuator is operated by the drive circuit 540 with the alternating current voltage, by expanding and contracting the chamber, the circulation pump 35 transports the ink I. In other words, the circulation pump 35 sucks the ink from the liquid hole 32*c* of the collection chamber 32 in the circulation path 41*a* and generates a pressure for feeding the ink I to the liquid hole 31*b* of the supply chamber 31. The circulation pump 35 is provided across the adjacent collection chamber 32 and the supply chamber 31 at one side of the ink casing 33.

As the supply pump 34 and the circulation pump 35, for example, a tube pump, a diaphragm pump, a piston pump or the like may be used.

Figure 4:
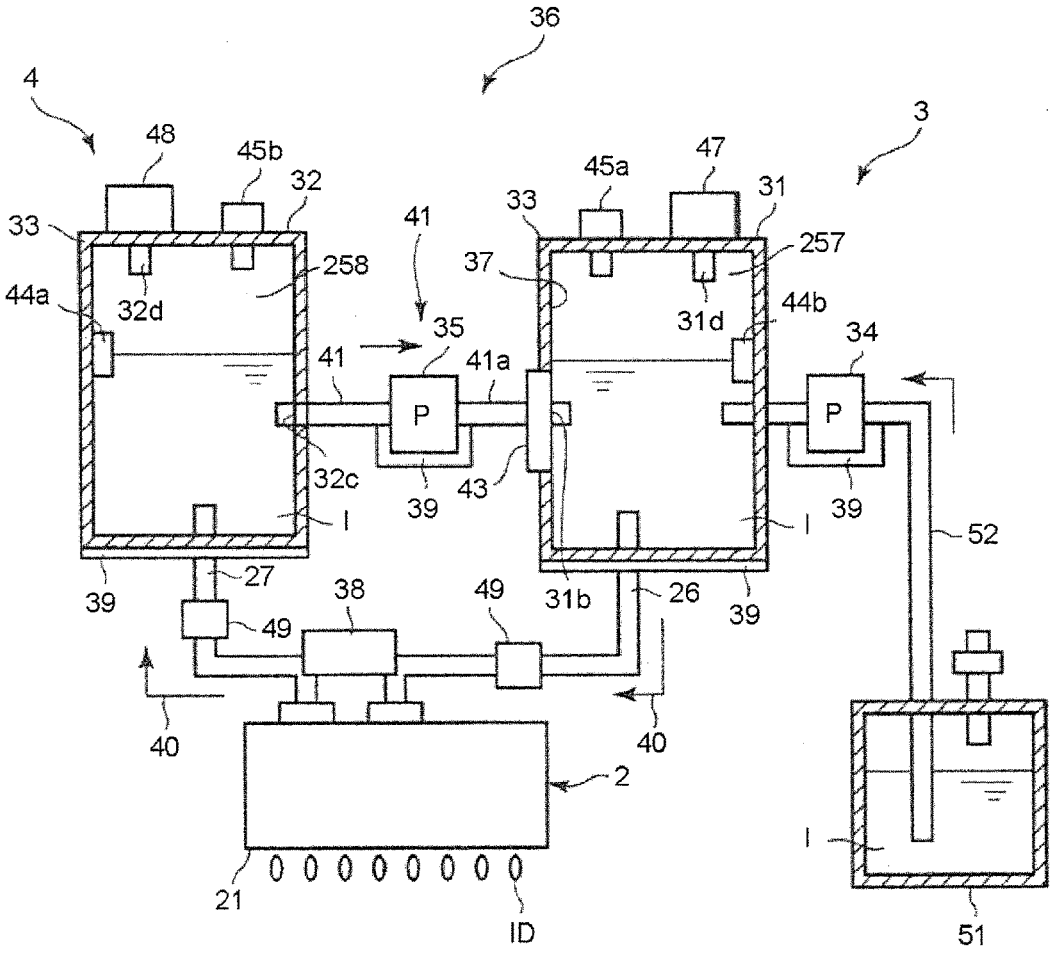
FIG. 4 is a view schematically illustrating the internal structure and a flow path of the ink supply circulation module.

As shown in FIG. 4, the filter 43 is, for example, located at the downstream side of the circulation pump 35 of the circulation path 41*a* in a circulation direction to remove foreign matters mixed in the ink I. As the filter 43, for example, polypropylene, nylon, polyphenylene sulfide, or mesh filter such as stainless steel is used.

While the ink is circulated from the collection chamber 32 to the supply chamber 31, the air bubbles in the ink I rise in the opposite direction (upward) to the direction of gravity due to buoyancy. The air bubbles rising due to buoyancy move to an air chamber above a liquid surface of the collection chamber 32 or a liquid surface of the supply chamber 31 to be removed from the ink. The filter 43 may also be located near an entrance to the ink supply pipe 26 in the supply chamber 31.

As shown in FIG. 4, the ink circulation device 30 includes a first ink quantity sensor (liquid surface sensor) 44*a* for measuring the ink quantity in the collection chamber 32 and a second ink quantity sensor (liquid surface sensor) 44*b* for measuring the ink quantity in the supply chamber 31. For example, the first ink quantity sensor (liquid surface sensor) 44*a* and the second ink quantity sensor (liquid surface sensor) 44*b* vibrate the piezoelectric vibration plate with the alternating current voltage and detect the vibration of the ink transmitted to the collection chamber 32 and the supply chamber 31 respectively to measure the ink quantities. The structures of the ink quantity sensors are not limited and they may measure the heights of a first liquid surface α1 and a second liquid surface α2. The ink circulation device 30 includes a temperature sensor 49 for detecting a temperature of the ink.

The ink circulation device 30 is provided with a first pressure sensor 45*a* for detecting the pressure in the collection chamber 32 and a second pressure sensor 45*b* for detecting the pressure in the supply chamber 31 as pressure detection sections. The pressure sensors 45*a* and 45*b* use, for example, semiconductor piezoresistance pressure sensors to output the pressure as electric signals. The semiconductor piezoresistance pressure sensor comprises a diaphragm for receiving external pressure and a semiconductor strain gauge formed on the surface of the diaphragm. The semiconductor piezoresistance pressure sensor detects the pressure by converting the change in the electrical resistance caused by the piezoresistance effect occurring in the strain gauge along with the deformation of the diaphragm due to the external pressure to an electric signal.

The pressure adjusting section 36 is provided with the first pressure adjusting mechanism 47 and the second pressure adjusting mechanism 48. The first pressure adjusting mechanism 47 and the second pressure adjusting mechanism 48 are, for example, piston type mechanisms that change the air volume by moving a piston up and down with a motor. The first pressure adjusting mechanism 47 and the second pressure adjusting mechanism 48 are capable of adjusting the pressure in the supply chamber 31 and the collection chamber 32 through expanding and compressing the air based on the information of the pressure detection sections.

The ink circulation device 30 circulates the ink in the circulation path 41*a* to supply the ink to the inkjet head 20, and sucks the air bubbles contained in the ink I or removes foreign matters. The ink circulation device 30 adjusts the pressure of the meniscus Me of the nozzle hole 21*a* by adjusting the pressure of a first pressure chamber 257 and a second pressure chamber 258. It is possible to fix the first pressure chamber 257 and adjust the pressure of the meniscus Me with the second pressure chamber 258. For example, with air control by the pressure adjusting section 36 and pressure adjustment due to an ink replenishment control by the supply pump 34, the pressure of the meniscus Me is maintained, for example, in a range of −2.0 kPa~−0.8 kPa to prevent unnecessary ink leakage or air bubble suction.

The ink circulation device 30 is provided with a heater 39 for raising the temperature of the ink and a cooling device 38 for reducing the temperature of the ink.

The ink circulation device 30 is further provided with the temperature sensor 49 for detecting the temperature of the circulation path 41*a* as a temperature detection section.

The ink cartridge 51 shown in FIG. 1 and FIG. 2 communicates with the ink circulation device 30 of the ink supply circulation module 40 via the tube 52. The ink cartridge 51 retains the ink supplied to the ink supply circulation module 40. The ink cartridge 51 is arranged relatively below the ink circulation device 30 in the direction of the gravity. In the present embodiment, the ink cartridge 51 is arranged relatively below the ink circulation device 30 in the direction of the gravity, in this way, a water head pressure of the ink in the ink cartridge 51 is maintained lower than set pressure of the supply chamber 31. The ink cartridge 51 is arranged below the ink circulation device 30, in this way, new ink is supplied from the ink cartridge 51 to the supply chamber 31 only when the supply pump 34 is driven.

The head support section 60 includes a carriage 61 for supporting the ink supply circulation module 40, a conveyance belt 62 for reciprocating the carriage 61 in an arrow A direction, and a carriage motor 63 for driving the conveyance belt 62. The head support section 60 movably supports the ink supply circulation module 40.

The image receiving medium moving section 70 movably supports an image receiving medium S. The image receiving medium moving section 70 is provided with a table 71 for adsorbing the image receiving medium S to fix it. The table 71 is mounted on a slide rail device 72 to reciprocate in an arrow B direction.

The maintenance unit 80 is arranged at a position beyond a moving range of the table 71 which is a scanning range of the ink supply circulation module 40 in the arrow A direction. The maintenance unit 80 is a case of which the upper side is opened and can be vertically moved.

The maintenance unit 80 is provided with a rubber blade, a waste ink receiving section and a mechanism for moving the blade in the arrow B direction, and wipes the surface of the nozzle plate 21 with the blade.

Figure 6:
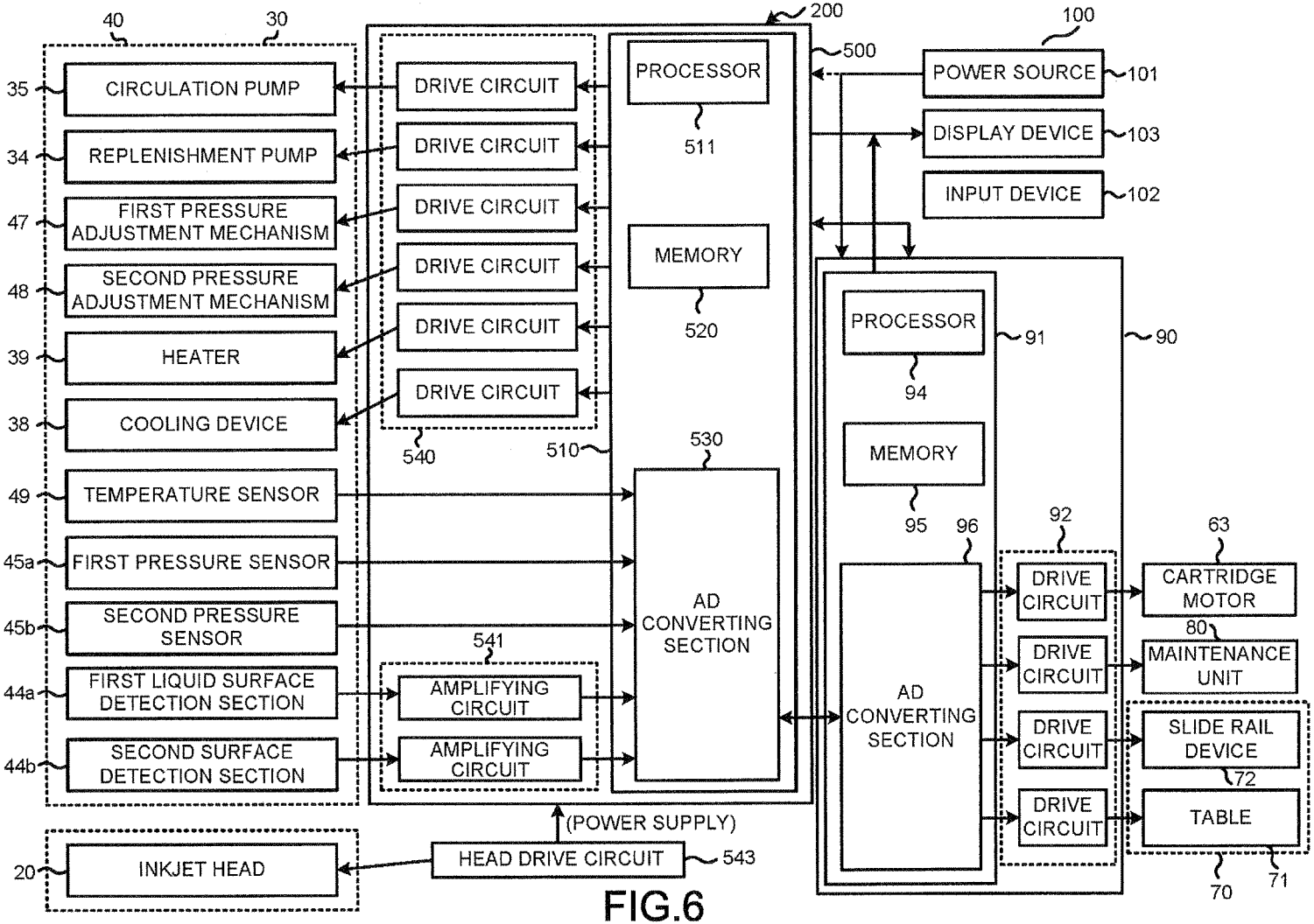
FIG. 6 is a block diagram illustrating a control system of the inkjet recording apparatus.

With reference to FIG. 6, a control system for controlling the operation of the ink supply circulation module 40 is described. The control system of the inkjet recording apparatus 10 according to the present embodiment includes the module control device 500 constituted integrally with the ink supply circulation module 40 and the host control device 90 constituted separately from the ink supply circulation module 40.

The host control device 90 of the inkjet recording apparatus 10 is connected to the power source 101, the input device 102 such as a keyboard, and the display device 103 for displaying the status of the ink circulation device 30.

The host control device 90 is a control substrate comprising a microcomputer 91 for controlling the inkjet recording apparatus 10 and a drive circuit 92 for driving each component.

The microcomputer 91 includes a processor 94 for controlling the operation of each section, a memory 95 for storing programs or various data, and an AD converting section 96 for converting analog data (voltage value) to digital data (bit data).

The host control device 90 is connected with various drive sections of the inkjet recording apparatus 10, for example, the table 71 of the image receiving medium moving section 70, the slide rail device 72, a drive section of the maintenance unit 80 and the carriage motor 63 of the conveyance belt 62.

The host control device 90 is connected to the ink supply circulation module 40 in a communicable manner via a signal line such as a USB cable.

The processor 94 acts as a central part of the host control device 90. The processor 94 controls each section of the inkjet recording apparatus 10 to realize various functions of the inkjet recording apparatus 10 according to an operating system and an application program.

The processor 94 detects input information input to the input device 102.

The processor 94 drives the carriage motor 63, the maintenance unit 80, the image receiving medium moving section 70 and the display device 103 according to various operating conditions and control programs that are input to the input device 102 or previously stored in the memory 95.

The processor 94 instructs the module control device 500 of the control programs and operating conditions by sending operating conditions to the module control device 500 according to, for example, various information and control programs.

In other words, by executing a control processing based on the control program by the processor 94, the host control device 90 having the processor 94 as the central part functions as a printing module for controlling a printing operation, a movement operation, a display operation and an instruction operation, a movement module, a display module and an instruction module.

The memory 95 acts as a main memory part of the host control device 90. The memory 95 includes a nonvolatile memory area and a volatile memory area. An operating system and an application program are stored in the nonvolatile memory area of the memory 95. The memory 95 stores data necessary for executing a processing by the processor 94 to control each section in the nonvolatile or volatile memory area in some cases. The memory 95 uses the volatile memory area as a work area where data is appropriately rewritten by the processor 94. Typically, a semiconductor memory is used as the memory 95. However, in addition to the semiconductor memory, storage devices of different types such as an HDD (hard disc drive) may be used.

The module control device 500 comprises a microcomputer 510, the drive circuit 540 for driving each component, an amplifying circuit 541 and a connection terminal 542 for connection on the control substrate 500*a* loaded at rear surface side of the pressure adjusting device.

The module control device 500 is connected to the power source 101, the display device 103 and the input device 102. The module control device 500 is also connected to the host control device 90 and is capable of communicating with the host control device 90.

The connection terminal 542 is, for example, a USB terminal for connecting the USB cable. The module control device 500 receives various information such as operating conditions by communicating with the host control device 90 in the state of being connected to the host control device 90 by the USB cable connected to the connection terminal 542.

The control substrate 500*a* is formed into, for example, a rectangle shape and is arranged at one side of the ink casing 33 and the pressure adjusting section 36 on the inkjet head 20.

The microcomputer 510 has a processor 511 for controlling the operation of each section, a memory 520 for storing a program or various data, and an AD converting section 530 for converting analog data (voltage value) to digital data (bit data).

The processor 511 acts as a central part of the module control device 500. The processor 511 controls each section of the ink supply circulation module 40 to realize various functions of the ink supply circulation module 40 according to the operating system and the application program.

The processor 511 controls the ink circulation device 30, which is connected to the drive sections of various pumps and various sensors of the ink circulation device 30.

The module control device 500 functions as a circulation module, a pressure adjusting module, a supply module and a mode switching module through executing a control processing by the processor 511 based on the control program that is recorded in the memory 520 in advance or instructed from the host control device 90.

For example, through controlling the operation of the circulation pump 35, the processor 511 functions as the circulation module for circulating the ink.

Through controlling the operation of the supply pump 34, the processor 511 functions as the supply module for supplying the ink to the circulation path from the ink cartridge.

The processor 511 functions as the pressure detection module having a function of acquiring information detected by the first pressure sensor 45*a*, the second pressure sensor 45*b*, the first liquid surface sensor 44*a* and the second liquid surface sensor 44*b* with the AD converting section 530. The processor 511 functions as the pressure adjusting module for carrying out the pressure adjustment by controlling the operation of the pressure adjusting section 36 and the supply pump 34 based on the pressure from the pressure sensors 45*a* and 45*b*.

The processor 511 stores necessary drive conditions in the memory 520 in a state in which the processor 511 can communicate with the host control device 90. Therefore, even if the communication with the host control device 90 is released thereafter, the ink supply circulation module 40 is capable of executing a stand-alone operation for executing various feedback operations such as a circulation control operation and a pressure control operation independently according to the drive conditions of the memory 520.

The memory 520 is, for example, a nonvolatile memory and is implemented on the module control device 500. Various control programs and operating conditions are stored in the memory 520 as information necessary for control of an ink circulation operation, an ink supply operation, a pressure adjustment, a temperature management and a liquid surface management of the ink. For example, a calibration value of a pressure sensor calibration that is last executed, the control program in a stand-alone mode, upper limit and lower limit vales of the pressure, upper and lower limit values of the temperature and the like are stored in the memory 520. For example, the upper and lower limit values of the pressure are set to a target pressure±0.1 kPa, and the upper and lower limit values of the temperature are set to a target temperature±0.1° C.

Figure 7:
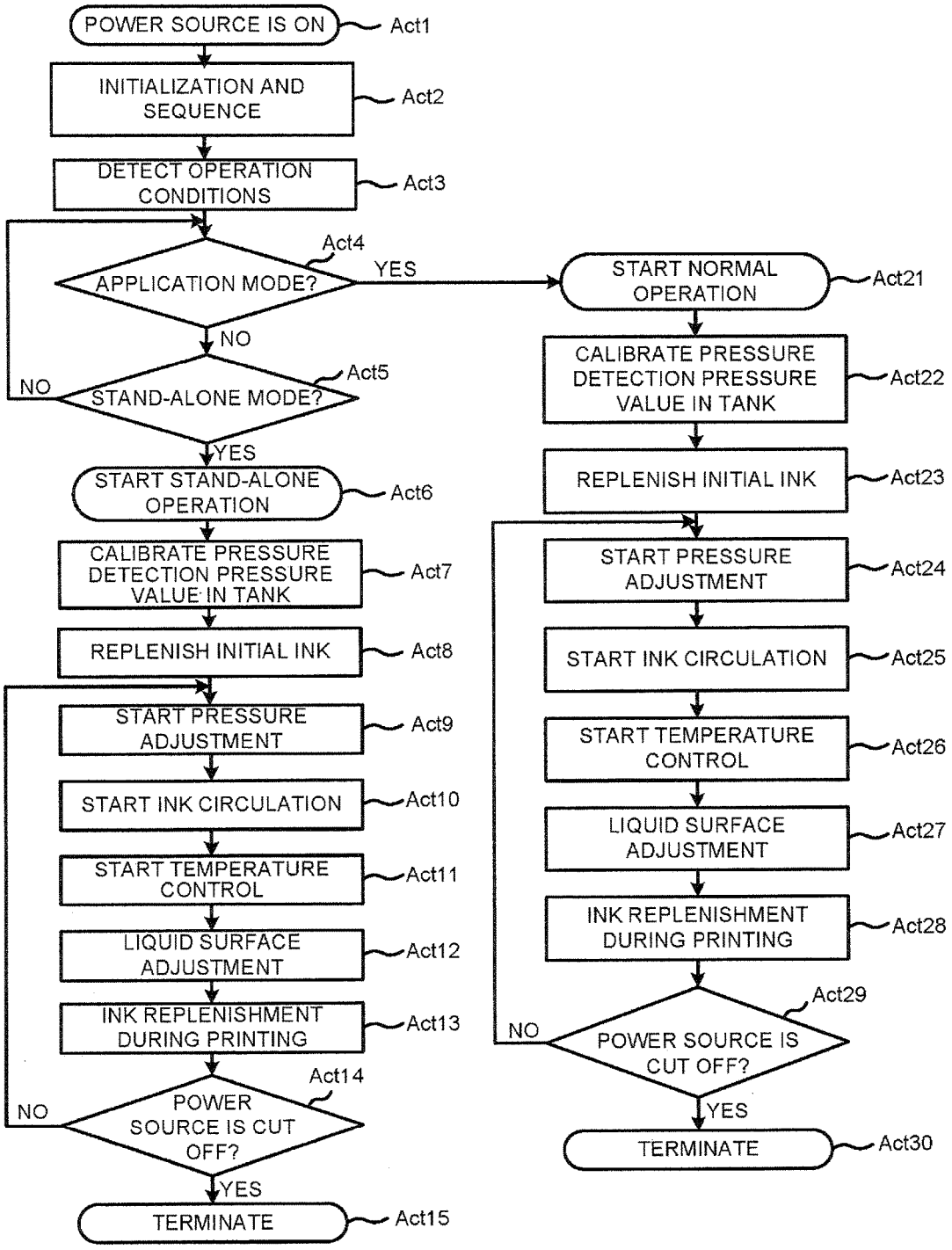
FIG. 7 is a flowchart illustrating the operation of the inkjet recording apparatus.

Hereinafter, the control by the processor 511 of the module control device 500 is described with reference to the flowchart in FIG. 7.

In the present embodiment, an example is described in which a mode is switched between the initial stand-alone mode and an application mode. The stand-alone mode is a mode in which the circulation operation and the feedback control are executed according to the programs and the operating conditions previously stored in the memory 520. The application mode is a mode in which the circulation operation and the feedback control are executed based on an instruction from the host control device 90.

The processor 511 detects that the power source 101 of the inkjet recording apparatus 10 is turned on (Act 1).

The processor 511 carries out an initialization operation under a sequence control (Act 2). As the initialization operations, for example, operation confirmation of the pressure adjusting mechanisms 47 and 48, operation confirmation of the pressure sensors 45*a* and 45*b*, operation confirmation of the liquid surface sensor 44*a* and 44*b* and operation confirmation necessary for operation of other components are carried out.

The processor 511 detects the operating conditions sent from the host control device 90 to store them in the memory 520 (Act 3).

The processor 511 determines whether or not the mode is the application mode based on the input instruction to the input device 102 and a connection state with the host control device 90 (Act 4). In Act 4, if it is determined that the mode is not the application mode (No in Act 4), the processor 511 determines whether or not the mode is the stand-alone mode (Act 5). Furthermore, if the determined that the mode is the application mode in Act 4 (Yes in Act 4), the processor 511 carries out a normal operation control subsequent to the processing in Act 21 described later according to the instruction from the processor 94.

If it is determined that the mode is the stand-alone mode (Yes in Act 5), the processor 511 starts a stand-alone control in Act 7~Act 15 (Act 6). Further, since the operation can be executed without carrying out communication in the stand-alone mode, the communication line is unnecessary, and the connection of the signal line with the host control device 90 can be released in the processing subsequent to the processing in Act 6.

In Act 7, the processor 511 carries out a calibration processing of the pressure value based on the relationship between the pressure value of each pressure sensor and the voltage value. The calibration processing is executed according to the programs stored in the memory 520 in advance and the instruction of a calibration start button provided in the input device 102 by the processor 511 through automatic sequence.

The processor 511 fills the ink I in the ink supply circulation module 40 from the ink cartridge 51 (Act 8). In particular, for example, in a case in which the inkjet recording apparatus 10 initially carries out the printing operation, the processor 511 drives the supply pump 34 to feed the ink from the ink cartridge 51 to the supply chamber 31. The cyan ink, the magenta ink, the yellow ink, the black ink, the white ink in the plurality of the ink cartridges 51 are initially filled in the plurality of the ink supply circulation modules 40. For example, if the ink I reaches the liquid hole 32*c* of the collection chamber 32 and the liquid hole 31*b* of the supply chamber 31, the processor 511 ends an initial filling of the ink I.

Prior to an initial ink replenishment operation, the processor 94 of the inkjet recording apparatus 10 raises the maintenance unit 80 to cover the nozzle plate 21 while moving the ink supply circulation module 40 to a standby position.

For example, after the processing in Act 8, at a predetermined timing, the processor 94 of the inkjet recording apparatus 10 controls the printing operation. As the printing operation, the processor 94 carries out the ink ejection operation to form an image on the image receiving medium S while reciprocating the ink supply circulation module 40 in a direction orthogonal to the conveyance direction of the image receiving medium S. In particular, the processor 94 absorbs the image receiving medium S to fix it on the table 71 and reciprocates the table 71 in the arrow B direction to move the maintenance unit 80 in the arrow C direction. The carriage 61 is conveyed to the image receiving medium S direction to reciprocate in the arrow A direction. The processor 94 selectively drives the actuator 24 of the inkjet head 20 with the head drive circuit 543 according to an image signal corresponding to the image data to eject the ink droplet ID from the nozzle hole 21*a* to the image receiving medium S.

The pressure of the ink casing 33 varies depending on ejection of the ink droplet ID from the nozzle hole 21*a* during the printing or the drive of the circulation pump 35. The processor 511 adjusts the pressure of the ink casing 33 in order to maintain the pressure of the ink casing 33 in a stable range in which the ink does not leak from the nozzle hole 21*a* or the air bubbles are not sucked from the nozzle hole 21*a*.

The processor 511 starts the pressure adjustment in accordance with a determined pressure adjusting value in such a manner that the pressure of the nozzle surface of the inkjet head 20 becomes a specified value (Act 9). In particular, the processor 511 drives the pressure adjusting section 36 according to detection results of the first pressure sensor 45*a* and the second pressure sensor 45*b*. The pressure in the ink casing 33 maintains a negative pressure such that the ink I does not leak from the nozzle hole 21*a* of the inkjet head 20 and the air bubbles are not sucked from the nozzle hole 21*a*. Through the negative pressure of the ink casing 33, the nozzle hole 21*a* maintains the meniscus Me of the negative pressure. Even if the power source 101 of the inkjet recording apparatus 10 is cut off in a state in which the initial filling of the ink I is completed, the ink casing 33 is in a sealed state, and the meniscus Me in the nozzle hole 21*a* maintains the negative pressure to prevent leakage of the ink.

The processor 511 drives the circulation pump 35 to start the ink circulation operation (Act 10). The ink I recirculating from the inkjet head 20 is circulated via the collection chamber 32, the circulation pump 35, the filter 43 (not shown) and the supply chamber 31 to be supplied to the inkjet head 20. The ink supply circulation module 40 circulates the ink I to remove air bubbles and foreign matters mixed in the ink I so as to favorably maintain an ink ejection performance. Thus, the print image quality is improved with the ink supply circulation module 40.

The processor 511 drives the heater 39 and the cooling device 38 based on the detection result of the temperature sensor 49 to adjust the temperature to the appropriate range (Act 11).

In Act 12 and Act 13, the processor 511 starts the liquid surface adjustment. In particular, the processor 511 carries out the ink replenishment from the ink cartridge 51 to adjust the liquid surface position to a proper range by driving the supply pump 34 according to the detection result of the first liquid surface sensor 44*a* and the second liquid surface sensor 44*b*. For example, the ink droplet ID is ejected from the nozzle hole 21*a* at the time of the printing, and the ink quantity of the ink casing 33 decreases instantaneously. If the liquid surface falls, the ink is replenished.

Hereinafter, the processor 511 carries out various feedback control in Act 9~Act 13 until it is detected that the power source is cut off in Act 14.

In Act 4, if it is determined that the mode is the application mode, the processor 511 carries out various feedback control processing same as the processing in Act 7~Act 15 based on the instruction from the processor 94 of the host control device 90 in a state of being connected with the host control device 90 via the communication line in Act 22~Act 30.

With such a constitution, according to the ink supply circulation module 40 and the inkjet recording apparatus 10 according to the present embodiment, the flowing effect can be achieved. In other words, by arranging the module control device 500 for controlling the ink circulation operation and the pressure adjusting operation integrally with the ink supply circulation module 40, the ink supply circulation module 40 can operate independently. Thus, in a state in which the communication with the host control device 90 is released, the ink supply circulation module 40 can be driven independently to be capable of carrying out the circulation operation and the feedback operation independently.

The ink supply circulation module 40 can switch the mode between the application mode and the stand-alone mode. At the time of designating the stand-alone mode, the ink supply circulation module 40 can be driven independently according to predetermined conditions. In the case of desiring to change the drive conditions, through connecting with the host control device 90 via the signal line again, it is possible to switch the mode to the application mode.

It is not necessary for the ink supply circulation module 40 to be usually connected with the signal line. Thus, the restriction of design and operation range is reduced. Therefore, the miniaturization and simplification of the inkjet recording apparatus 10 are realized. Specifically, even if plural ink supply circulation modules 40 are mounted, complicated wiring becomes unnecessary, and the simplification of the device is realized.

The ink supply circulation module 40 according to the present embodiment is loaded with the ink circulation device 30 of which outer side surface fits within the predetermined range above the inkjet head 20. The ink circulation device 30 is loaded with the ink casing 33 and the pressure adjusting section 36 on the inkjet head 20, and is also loaded with the circulation pump 35, the supply pump 34 and the control substrate 500*a* on one side part of the ink casing 33 and the pressure adjusting section 36. The appearance of the cover 30*a* covering the outer wall is formed in the same shape as the appearance of the inkjet head 20 in a plain view. In other words, the components required for the stand-alone operation are compactly and integrally formed to be capable of dealing with various applications and use statuses. Thus, for example, the components are easily used as a substitute for another type of inkjet head which is commonly used such as one-way supply type. The components can also be used as the ink supply circulation module for evaluating the inkjet head of a circulation type or also as a kit for evaluation of a small amount of the ink, and have high versatility.

The configuration of the liquid circulation device of the embodiments described above is not limited.

In the above embodiment, an example is shown in which the devices are connected by a USB cable in a communicable manner, but the present invention is not limited thereto. For example, as another embodiment, the host control device 90 of the inkjet recording apparatus 10 has a wireless function, and thus, the host control device 90 and the module control device 500 may be capable of wirelessly communicating with each other. In this case, the signal lines can be omitted in both the application mode and the stand-alone mode.

The ink circulation device 30 may be connected to a head power source for the inkjet head 20 via a power source line separately arranged. In this case, by driving the ink supply circulation module 40 with the head power source, it is possible to omit the connection with the power source 101.

Figure 8:
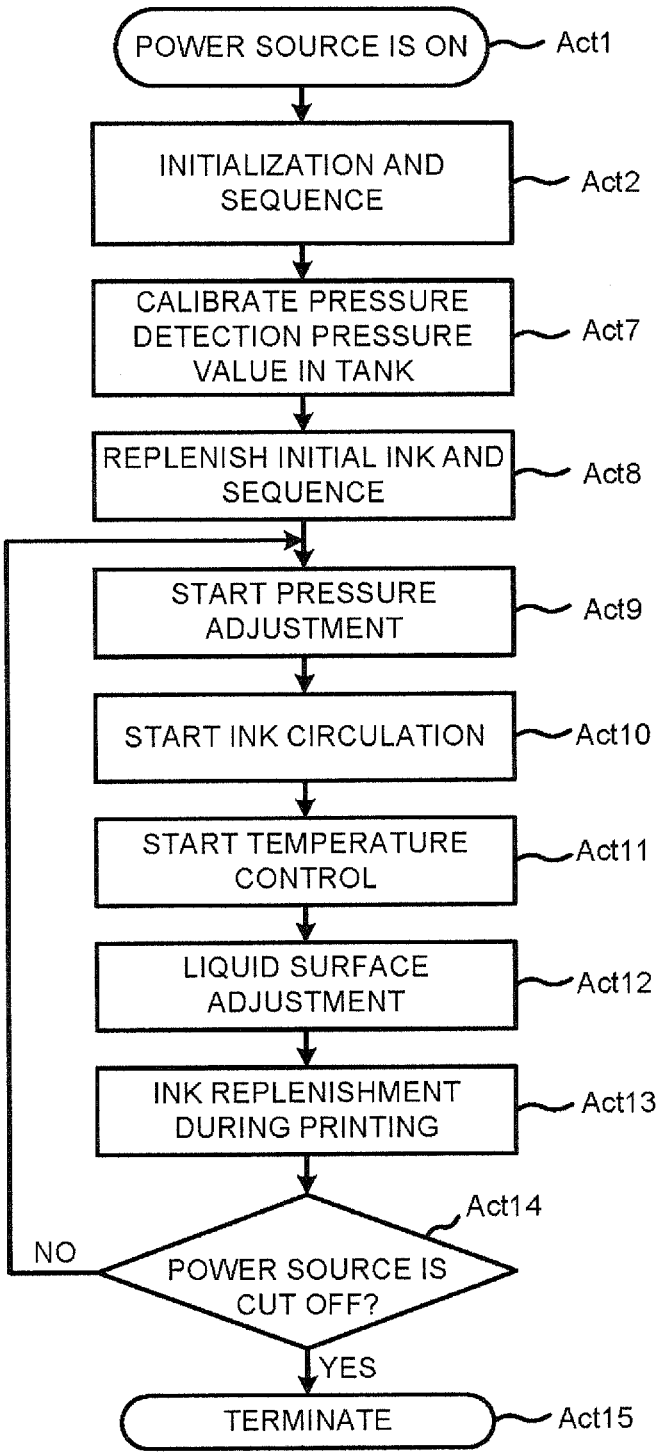
FIG. 8 is a flowchart illustrating the operation of an inkjet recording apparatus according to another embodiment.

For example, in the above embodiment, the application mode or the stand-alone mode is first selected and the ink supply circulation module 40 is operable in plural modes; however, the present invention is not limited to this. As shown in FIG. 8, as another embodiment, for example, at the time point the power source is turned on, it is also possible to execute the stand-alone operation based on previously stored information.

Figure 9:
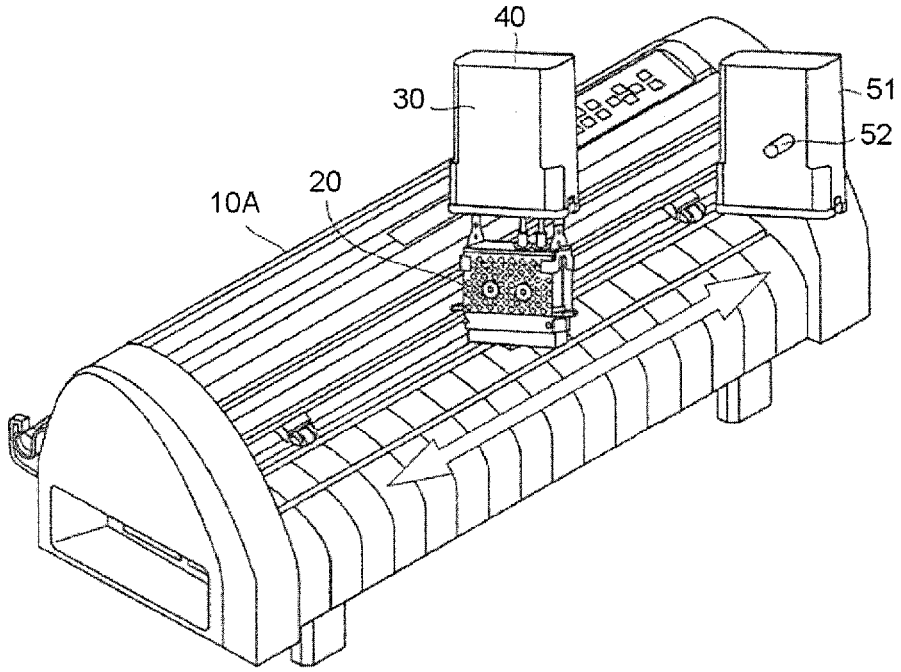
FIG. 9 is a perspective view illustrating the schematic constitution of the inkjet recording apparatus according to another embodiment.

As another embodiment, an inkjet recording apparatus 10A shown in FIG. 9 is a serial printer, and an ink supply circulation module 40A is capable of reciprocating and is detachable from the ink cartridge 51. For example, in a case in which the ink runs short during the printing, by returning to a predetermined position, the ink supply circulation module 40A is temporarily connected to the ink cartridge 51 and the ink replenishment operation is automatically executed.

Figure 10:
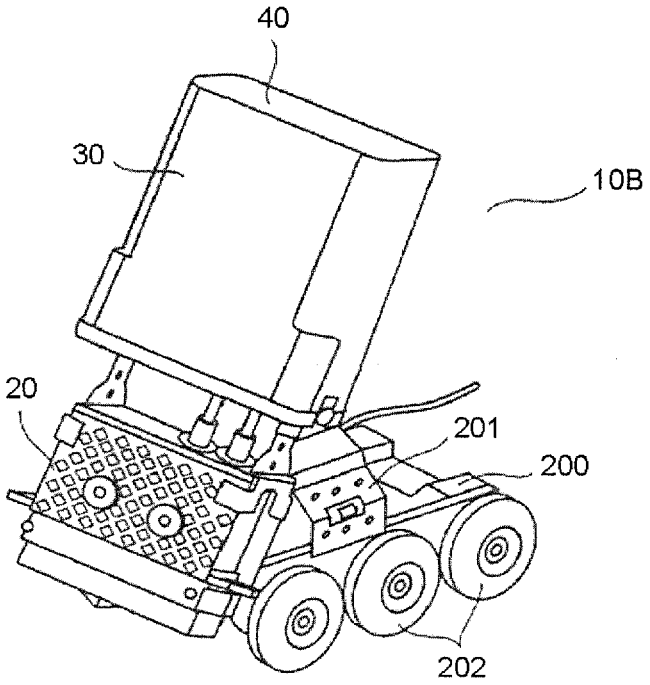
FIG. 10 is a perspective view illustrating the schematic constitution of the inkjet recording apparatus according to another embodiment.

As another embodiment, a self-propelled type inkjet recording apparatus 10B shown in FIG. 10 in which a moving mechanism 200 is integrally provided in the ink supply circulation module 40 of the foregoing embodiment is capable of freely traveling.

The movement mechanism 200 includes, for example, a plurality of wheels 202 and a motor 201 for rotationally driving the wheels 202. The motor 201 is controllable by the processor 511 of the module control device 500. In the present embodiment, a traveling program and a traveling condition of the moving mechanism 200 are also stored in the memory 520 of the module control device 500. In the present embodiment, in addition to the circulation operation and the pressure adjusting operation, the processor 511 controls the movement operation of the movement mechanism 200. In other words, the processor 511 also functions as a movement module.

In the inkjet recording apparatus 10B according to the present embodiment, the ink supply circulation module 40B is capable of circulating the ink and moving independently. Therefore, while the ink supply circulation module 40B moves on a printing object, the image can be formed.

The liquid ejection apparatus can also eject liquid other than the ink. A liquid ejection apparatus which ejects the liquid other than the ink may be, for example, an apparatus that ejects liquid containing conductive particles to form a wiring pattern of a printed wiring substrate.

In addition to the above, the inkjet head 20 may also be a structure for ejecting the ink droplet by deforming the vibration plate with static electricity or a structure for ejecting the ink droplet from a nozzle by using thermal energy of a heater or the like.

The pressure adjusting section 36 is not limited to use the above piston mechanism; for example, the pressure adjusting section 36 may use a tube pump or a bellows pump and the like. For example, by increasing or decreasing gas in the first pressure chamber 257 composed of the air in the supply chamber 31 and the second pressure chamber 258 composed of air in the collection chamber 32, the pressure adjusting section 36 may carry out pressurization or depressurization.

Although the embodiments of the invention are described above, these embodiments are illustrated as examples but not as limitations to the scope of the present invention. Novel embodiments may be embodied in a variety of other forms; furthermore, various omissions, substitutions, variations or combinations may be devised without departing from the spirit of the inventions. The accompanying claims and their equivalents are intended to cover such embodiments or modifications as would fall within the scope and spirit of the inventions.

What is claimed is:

1. A liquid circulation module comprising:

a liquid ejection head configured to eject liquid;

a storage section connected with the liquid ejection head for storing the liquid;

a circulation section configured to circulate the liquid in a predetermined circulation path through the liquid ejection head and the storage section;

a pressure detection section configured to detect pressure in the storage section;

a pressure adjusting section configured to adjust pressure in the storage section; and a module controller configured to control a circulation operation of the circulation section and a pressure adjusting operation of the pressure adjusting section, wherein the module controller is situated on a side of the circulation section.

2. The liquid circulation module according to claim 1, wherein the module controller comprises a memory for storing operating conditions and control programs of the circulation operation, the pressure adjusting operation, and a supply operation of the supply pump, and controls the circulation operation, the pressure adjusting operation, and the supply operation according to operating conditions stored in the memory.

3. The liquid circulation module according to claim 1, further comprising:

a supply pump, arranged at the upper side of the liquid ejection head, configured to replenish ink into the circulation path, wherein the storage section, arranged at the upper side of the liquid ejection head, comprises a collection chamber for storing liquid collected from the liquid ejection head and a supply chamber for storing the liquid supplied to the liquid ejection head, the circulation section, arranged at the upper side of the liquid ejection head, comprises a circulation pump for generating pressure for circulating the liquid in the circulation path, the pressure adjusting section is arranged above the storage section.

4. The liquid circulation module according to claim 2, wherein the module controller comprises a mode switching module for switching between an application mode for controlling the circulation operation according to an instruction from the host controller and a stand-alone mode for controlling the circulation operation according to the operating conditions stored in the memory.

5. The liquid circulation module according to claim 1, further comprising:

a moving mechanism; wherein the module controller controls a movement operation of the moving mechanism.

6. The liquid circulation module according to claim 1, wherein the circulation section comprises a tube pump, a diaphragm pump, or a piston pump.

7. The liquid circulation module according to claim 1, further comprising:

an ink quantity sensor for measuring quantity of ink.

8. The liquid circulation module according to claim 1, wherein the pressure adjusting section comprises a piezoelectric element.

9. A liquid ejection apparatus, comprising:

a liquid circulation module; and wherein the liquid circulation module comprising:

a liquid ejection head configured to eject liquid;

a storage section connected with the liquid ejection head for storing the liquid;

a circulation section configured to circulate the liquid in a predetermined circulation path passing through the liquid ejection head and the storage section;

a pressure detection section configured to detect pressure in the storage section;

a pressure adjusting section configured to adjust pressure in the storage section; and a module controller configured to control a circulation operation of the circulation section and a pressure adjusting operation of the pressure adjusting section, wherein the module controller is located on a side of the circulation section.

10. The liquid ejection apparatus, according to claim 9, wherein the module controller comprises a memory for storing operating conditions and control programs of the circulation operation, the pressure adjusting operation, and a supply operation of the supply pump, and controls the circulation operation, the pressure adjusting operation, and the supply operation according to operating conditions stored in the memory.

11. The liquid ejection apparatus according to claim 9, further comprising:

a supply pump, arranged at the upper side of the liquid ejection head, configured to replenish ink into the circulation path, wherein the storage section, arranged at the upper side of the liquid ejection head, comprises a collection chamber for storing liquid collected from the liquid ejection head and a supply chamber for storing the liquid supplied to the liquid ejection head, the circulation section, arranged at the upper side of the liquid ejection head, is a circulation pump for generating pressure for circulating the liquid in the circulation path, the pressure adjusting section is arranged above the storage section.

12. The liquid ejection apparatus according to claim 11, wherein the module controller comprises a mode switching module for switching between an application mode for controlling the circulation operation according to an instruction from the host controller and a stand-alone mode for controlling the circulation operation according to the operating conditions stored in the memory.

13. The liquid ejection apparatus according to claim 9, further comprising:

a moving mechanism; wherein the module controller controls a movement operation of the moving mechanism.

14. The liquid ejection apparatus according to claim 9, further comprising:

an ink quantity sensor for measuring quantity of ink.

15. The liquid ejection apparatus according to claim 9, wherein the pressure adjusting section comprises a piezoelectric element.

16. A liquid circulation method for an inkjet recording apparatus, comprising:

circulating, by a circulation section, inkjet liquid in a predetermined circulation path through a liquid ejection head and a storage section;

detecting pressure in the storage section;

adjusting pressure in the storage section; and controlling, by a module controller that is located at a side of the circulation section, circulating inkjet liquid and adjusting pressure in the storage section.

17. The liquid circulation method according to claim 16, further comprising:

replenishing inkjet liquid into the circulation path, storing liquid collected from the inkjet liquid ejection head and a supply chamber for storing the liquid supplied to the inkjet liquid ejection head, and generating pressure for circulating the inkjet liquid in the circulation path.

18. The liquid circulation method according to claim 17, further comprising:

switching between an application mode for controlling the circulation and a stand-alone mode for controlling the circulation.

19. The liquid circulation method according to claim 16, further comprising:

controlling a movement operation of a moving mechanism.

20. The liquid circulation method according to claim 16, further comprising:

measuring quantity of the ink liquid.

* * * * *